US005263326A

United States Patent [19]

Block et al.

[11] Patent Number: 5,263,326

[45] Date of Patent: Nov. 23, 1993

[54] HALOGENATED HYDROCARBON RECYCLING MACHINE

[75] Inventors: Mathias Block, Offenbach, Fed. Rep. of Germany; Padraig Furlong, Ashbourne, Ireland; Brian Keogh, Dublin, Ireland; Brendan Farrell, Dublin, Ireland; John Byrne, Dublin, Ireland

[73] Assignee: Team Aer Lingus, Ireland

[21] Appl. No.: 785,743

[22] Filed: Oct. 31, 1991

[30] Foreign Application Priority Data

Mar. 21, 1991 [IE] Ireland ..... 937/91
Sep. 13, 1991 [IE] Ireland ..... 3235/91

[51] Int. Cl.[5] ..... F25J 3/00; F25B 45/00

[52] U.S. Cl. ..... 62/18; 62/292; 62/77; 141/2

[58] Field of Search ..... 62/18, 20, 77, 149, 62/292; 137/15; 141/2, 11, 82

[56] References Cited

U.S. PATENT DOCUMENTS

| | | | |
|---|---|---|---|
| 4,053,001 | 10/1977 | Healey et al. | 141/2 |
| 4,363,222 | 12/1982 | Cain | 62/292 |
| 4,441,330 | 4/1984 | Lower et al. | 62/292 X |
| 4,805,416 | 2/1989 | Manz et al. | 62/474 X |
| 4,903,499 | 2/1990 | Merritt | 62/292 X |
| 4,939,905 | 7/1990 | Manz | 62/292 X |
| 4,969,495 | 11/1990 | Grant | 141/82 X |
| 5,018,361 | 5/1991 | Kroll et al. | 62/292 X |
| 5,024,061 | 6/1991 | Pfeil, Jr. et al. | 62/292 X |
| 5,067,327 | 11/1991 | Leblanc | 141/82 X |
| 5,076,063 | 12/1991 | Kamegasawa | 62/292 X |
| 5,078,756 | 1/1992 | Major et al. | 62/77 X |
| 5,097,667 | 3/1992 | Gramkow | 62/77 |
| 5,101,637 | 4/1992 | Daily | 62/292 X |
| 5,150,577 | 9/1992 | Mitchell | 62/18 |

FOREIGN PATENT DOCUMENTS

| | | |
|---|---|---|
| 0038958 | 11/1981 | European Pat. Off. . |
| 0308149 | 3/1989 | European Pat. Off. . |
| 0329321 | 8/1989 | European Pat. Off. . |
| 0374966 | 6/1990 | European Pat. Off. . |
| 0452026 | 10/1991 | European Pat. Off. . |
| 2231136 | 11/1990 | United Kingdom . |

*Primary Examiner*—Henry A. Bennet
*Assistant Examiner*—Christopher B. Kilner
*Attorney, Agent, or Firm*—Ostrolenk, Faber, Gerb & Soffen

[57] ABSTRACT

A halogenated hydrocarbon recycling machine M1 comprising a cylinder-emptying apparatus including means for transferring a vapour mixture from a cylinder 10 to a fluid storage reservoir R1, a cylinder-filling apparatus including means for filling the cylinder 10[1] from the reservoir R1 and a fluid separating apparatus including means for separating from the vapour mixture of an emptied cylinder, a reusable halogenated hydrocarbon fluid for use by the cylinder filling apparatus.

11 Claims, 14 Drawing Sheets

CYLINDER EMPTYING SEQUENCE

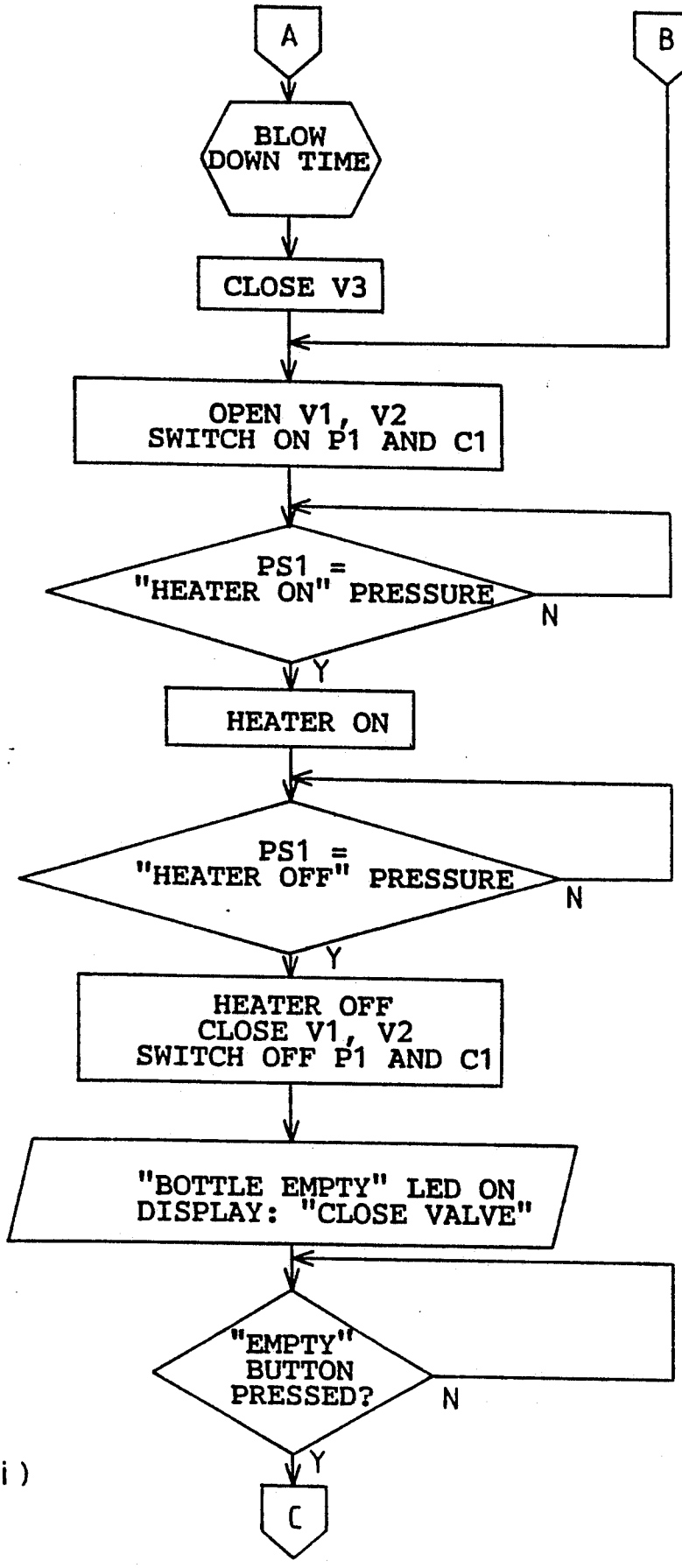
FIGURE 1b(ii)

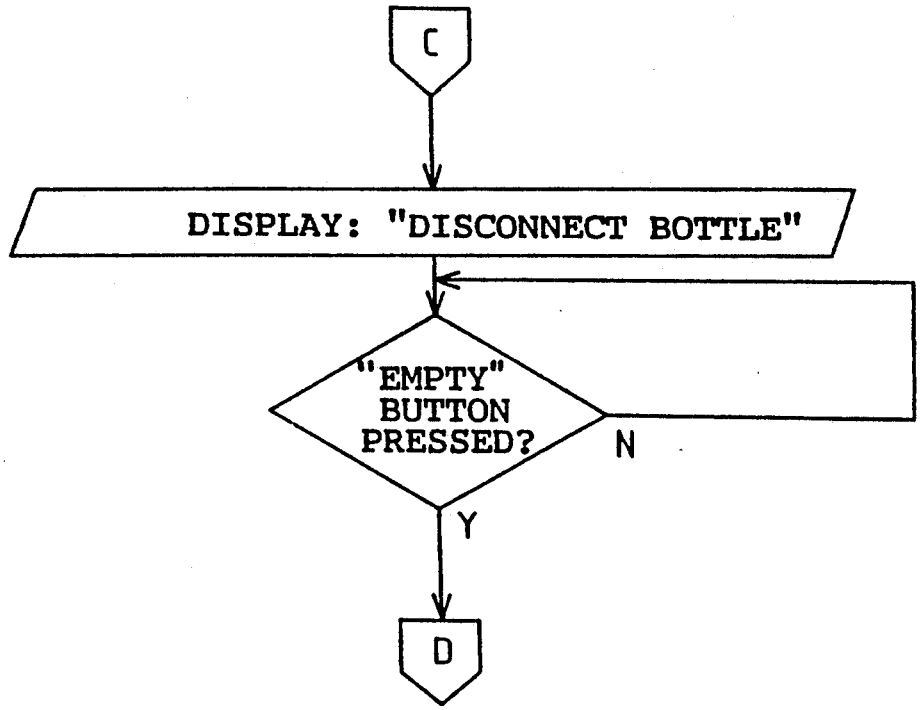
FIGURE 1b (iii)

CYLINDER FILLING SEQUENCE

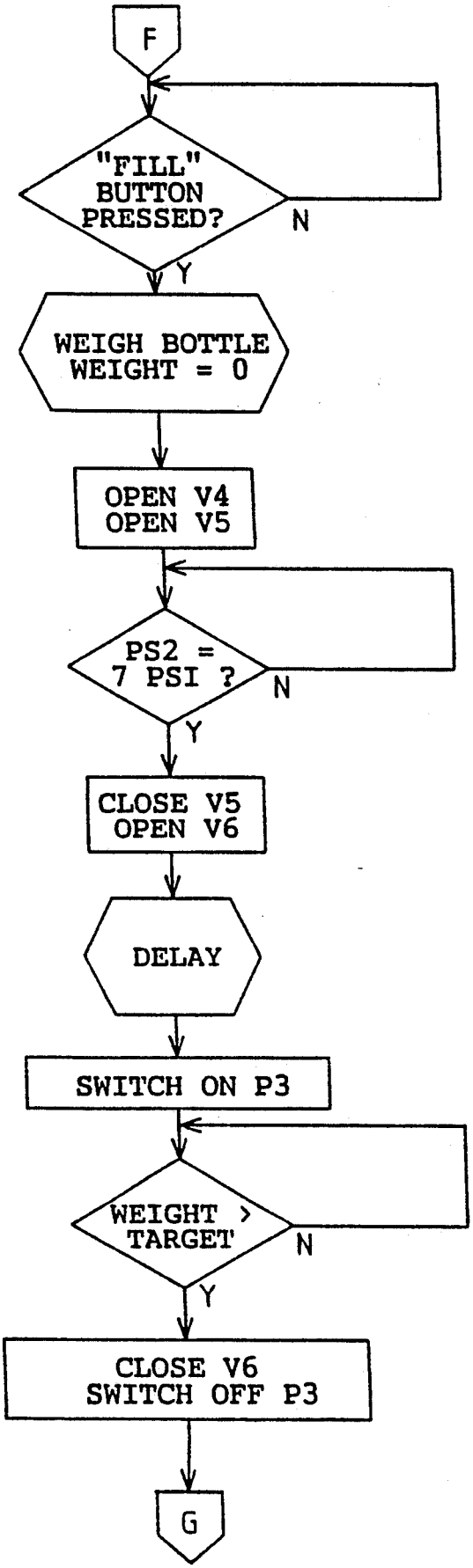
FIGURE 2b(ii)

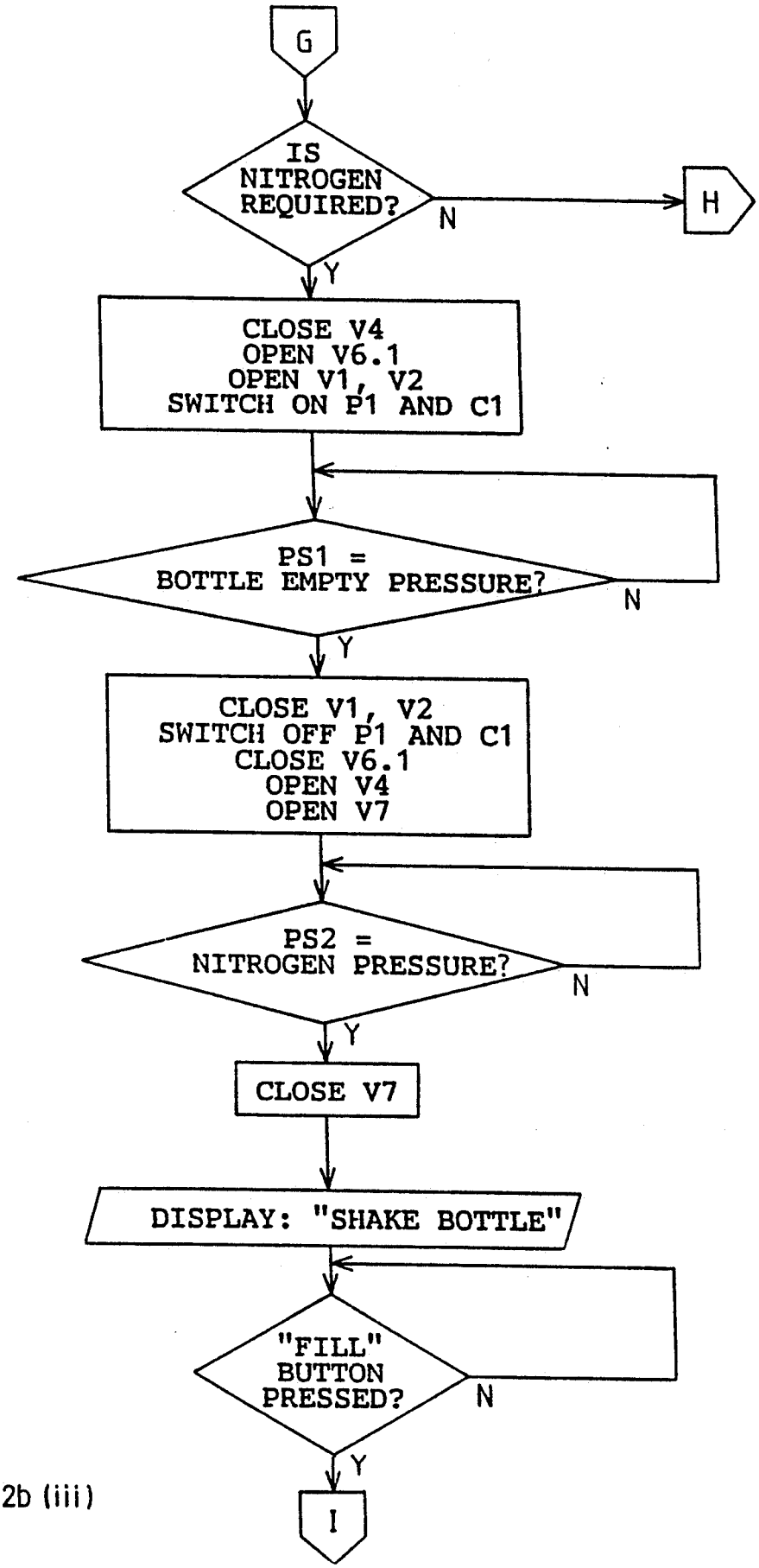
FIGURE 2b (iii)

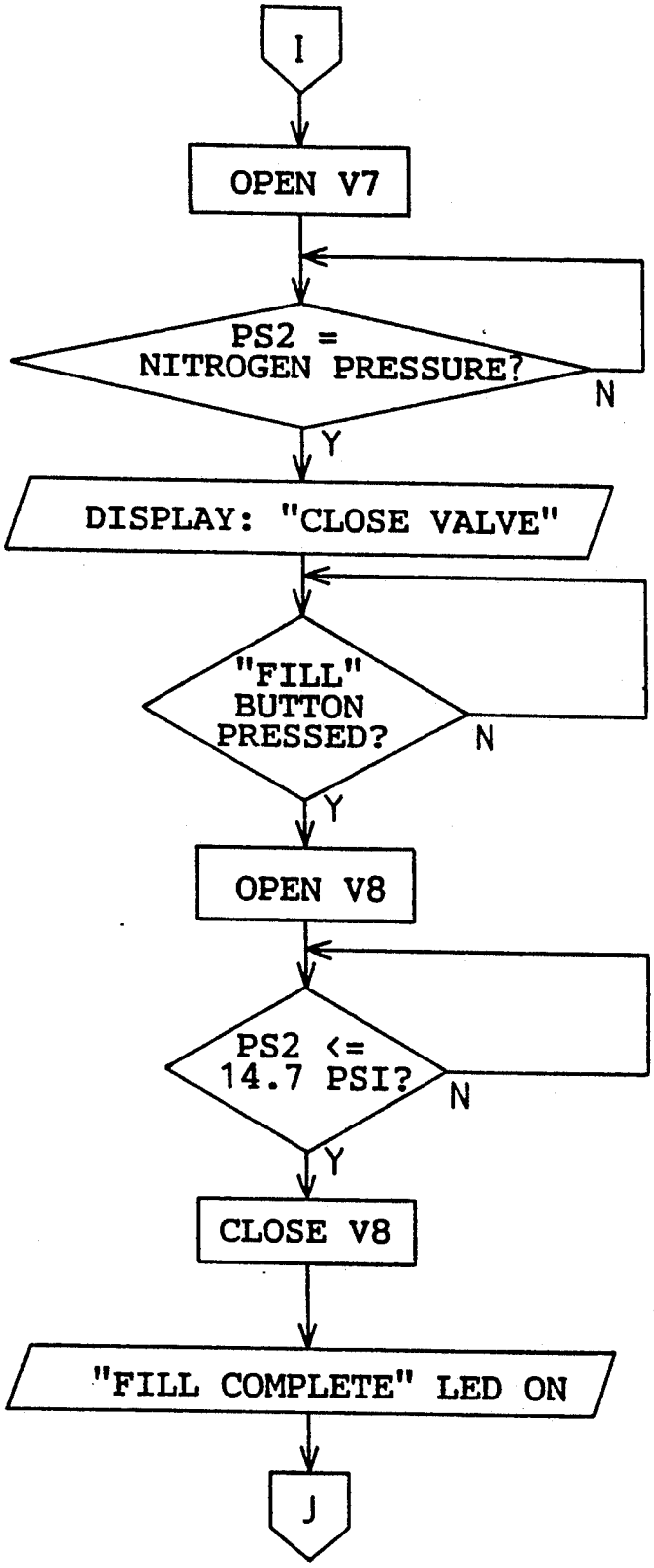
FIGURE 2b(iv)

HALOGENATED HYDROCARBON RECYCLING MACHINE

The present invention concerns improvements in and relating to halogenated hydrocarbon recycling machines.

BACKGROUND OF THE INVENTION

Fire extinguisher cylinders generally include Chlorofluorocarbons (CFC's), Hydrochlorofluorocarbons (HCFC's) and Hydrofluorocarbons (HFC's) in the cylinder as fire-fighting agents.

When it is necessary to empty such a cylinder for servicing, repair or pressure testing, the valve on the cylinder is opened and the contents thereof allowed to escape under their own vapour pressure into the atmosphere. This has the disadvantage of being highly wasteful and furthermore such release of halogenated hydrocarbons is highly damaging to the ozone layer and hence extremely undesirable from an environmental point of view.

The present invention is particularly concerned with fire extinguisher cylinders containing halogenated hydrocarbon vapours including Halon 1211, Halon 1301, ($CF_3BR$) Halon 2402, Refrigerant R13B1 and Refrigerant R22, for example, either on their own or superpressurized with nitrogen.

The term "halon" will be used hereafter to mean any of the above halogenated hydrocarbons, by way of example to illustrate the operation of the various aspects of the invention. The term "fluid" will be taken to include liquid, vapour and gas.

SUMMARY OF THE INVENTION

The present invention accordingly provides a halogenated hydrocarbon recycling machine comprising a cylinder-emptying apparatus including means for transferring a vapour mixture from a cylinder to a reservoir, a cylinder-filling apparatus including means for filling the cylinder from said reservoir and a fluid separating apparatus including means for separating from the vapour mixture of an emptied cylinder, a reusable halogenated hydrocarbon fluid for use by the cylinder filling apparatus.

The fluid separating apparatus advantageously comprises a thermal separation unit which includes at least one receiving vessel, at least one condenser and a valve, said condenser being arranged above the receiving vessel so that vapour rising from the receiving vessel is allowed to condense in the condenser and return to the receiving vessel, said valve being located beneath the receiving vessel; said receiving vessel containing a float switch which is operable by the level of liquid in the receiving vessel, to actuate said valve; whereby when the valve is in an open condition, liquid halogenated hydrocarbon may flow from the receiving vessel via said valve to the reservoir.

Conveniently, the fluid separating apparatus comprises a thermal separation unit which includes a plurality of receiving vessels and a plurality of respective condensers, the receiving vessels being arranged in series, each receiving vessel being maintained at a temperature which is lower than that of a receiving vessel occurring earlier in the series, each condenser being arranged above each receiving vessel such that vapour rising from the respective receiving vessel is allowed to condense in the condenser and return to the respective receiving vessel, a plurality of valves, each respective valve being located beneath each receiving vessel, each receiving vessel containing a respective float switch, each of which float switches is operable by the level of liquid in each respective receiving vessel, to actuate said respective valve; whereby when a valve is in an open condition, liquid halogenated hydrocarbon may flow from the respective receiving vessel via said valve to the respective reservoir.

Preferably, the fluid separating apparatus further comprises a reference cylinder of pure halogenated hydrocarbon having a given vapour pressure, said cylinder being connected via a network of piping to respective differential pressure switches, each differential pressure switch being operable to measure the pressure at given points on said network of piping with respect to said reference cylinder.

Advantageously, the cylinder emptying apparatus further includes a cylinder retaining means including a housing having an aperture adapted to receive a portion of a fire extinguisher cylinder, said cylinder retaining means having a heating element which is located therein, the heating element being positioned within the housing so that when the fire extinguisher is placed in said aperture, an exit valve on said fire extinguisher is located close to the heating element.

Ideally, the fluid separating apparatus further includes a chemical adsorber having an adsorbent medium comprising molecular sieves.

The cylinder filling apparatus preferably includes cylinder retaining means comprising weighing means.

Conveniently, the weighing means includes a load cell.

Advantageously, the cylinder retaining means further comprises anti-debris members.

Conveniently, the cylinder filling apparatus includes vibrating means which act to agitate said fire extinguisher cylinder during pressurizing thereof using inert vapour.

BRIEF DESCRIPTION OF THE DRAWINGS

The invention will now be described more particularly with reference to the accompanying drawings which show, by way of example only, one embodiment of the recycling machine according to the invention which includes a cylinder emptying apparatus, a cylinder filling apparatus and a fluid separating apparatus.

In the drawings.

DETAILED DESCRIPTION OF THE PREFERRED EMBODIMENT OF THE INVENTION

The complete halogenated hydrocarbon recycling machine will now be described with reference to the drawings; the cylinder emptying apparatus first, then the cylinder filling apparatus and finally the fluid separating apparatus. Some components are common to the three apparatus and will be referred to by the same designation.

Figure 4:
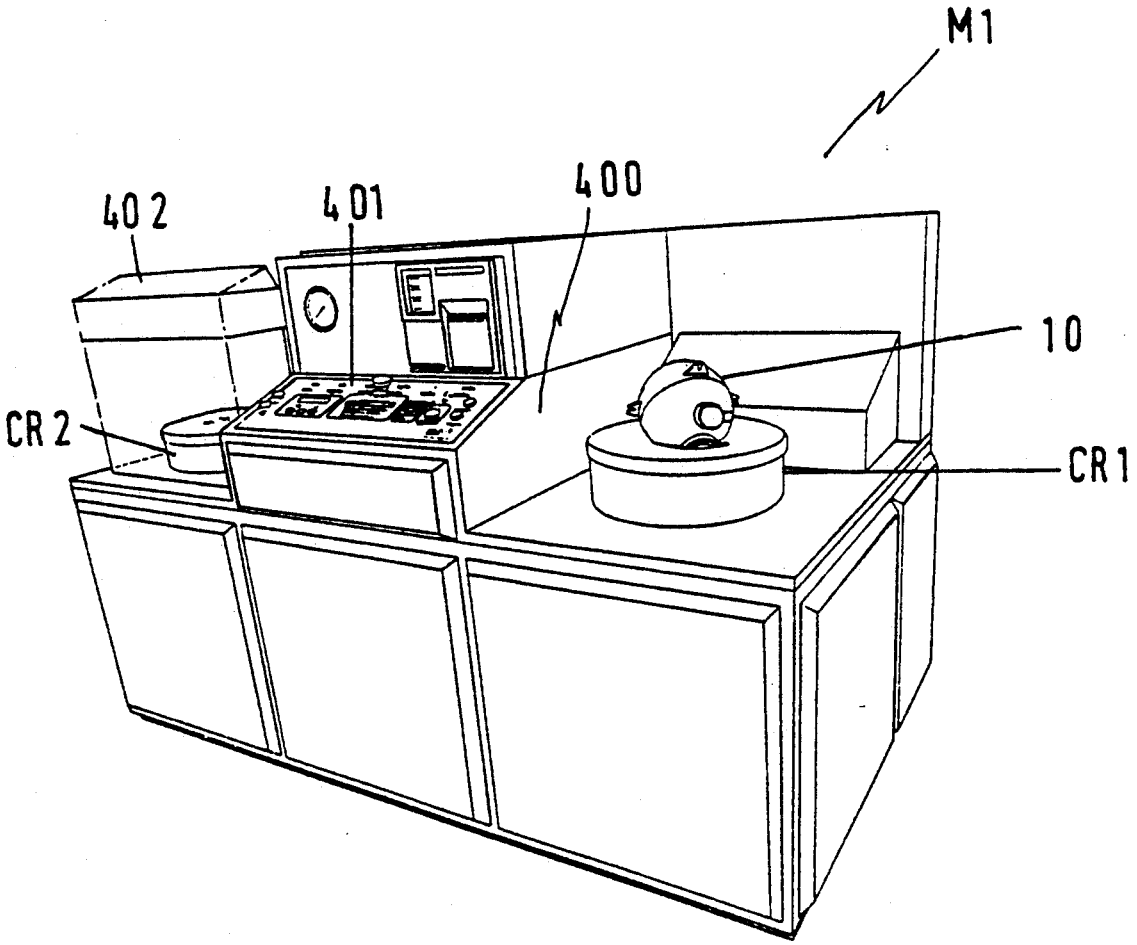
FIG. 4 is a perspective view of the exterior of the recycling machine with a fire extinguisher cylinder mounted on it.

Referring initially to FIG. 4, the halogenated hydrocarbon recycling machine is indicated by the reference M1.

Referring now to FIGS. 1, 1*a*, 1*b* and 4, the construction and operation of the cylinder-emptying apparatus will be described. The cylinder-emptying apparatus includes a cylinder retainer CR1, high pressure filter F1, pressure generator PG1 and fluid storage vessel R1, all connected by pipe 14. The cylinder retainer CR1 includes a heating element H1, and the pressure generator PG1 includes valves V1, V2 and condenser C1, pressure transducer PS1, pump P1 on one leg of a flow circuit and valve V3 on the second leg of the flow circuit. One end of the pipe 14 is flexible and is held within a stainless steel housing 60 of the cylinder retainer CR1, the housing 60 having a PTFE lining. A fire extinguisher cylinder 10 containing a nitrogen/halon vapour mixture and having a valve 11 is shown mounted on the cylinder retainer CR1. The retainer CR 1 also includes a plate 13 mounted on support member 131, the plate 13 having an aperture adapted to receive the cylinder 10.

In order to empty the halon and nitrogen vapour mixture from the fire extinguisher cylinder 10, it is placed on the plate 13 of the cylinder retainer CR1 and positioned so that the valve 11 is protruding through the aperture on the plate 13.

The emptying cycle is controlled by a computer 400; an operator starts the procedure by pressing a button marked "empty" on a computer control panel 401. A message is subsequently displayed which prompts the operator to manually connect the valve 11 to the flexible end of pipe 14 and to open valve 11. The operator then presses the "Empty" button again and if the cylinder is not empty, the emptying cycle continues. Under computer control, valve V3 opens while valves V1 and V2 remain closed. The valve V3 is kept open for a pre-determined period of time, usually 30–40 seconds and some halon/nitrogen vapour mixture flows from cylinder 10 to the fluid storage vessel R1 due to a pressure differential which exists therebetween. Valve V3 is then closed and valves V1 and V2 are opened by the computer. Since the pressure differential between the cylinder 10 and storage vessel R1, is no longer sufficient to force the vapour mixture from the cylinder 10 to storage vessel R1, the pump P1 is now activated so as to empty the cylinder 10. The halon/nitrogen vapour mixture flows into condenser C1 and then to storage vessel R1 via valve V2. During the emptying operation, the heater H1 is activated as required. The activation of the heater is controlled by the pressure transducer PS1 which measures the vapour pressure in the cylinder 10. There is a correlation between the vapour pressure and the temperature in the cylinder 10 and therefore the former serves as a useful parameter to control the activation of the heating element H1. During emptying, there is a drop in temperature due to the latent heat of vaporization.

This drop in temperature results in the freezing/icing up of the outlet valve with a consequent blocking of the valve and a consequent stopping of the halon/nitrogen vapour flow. Controlled heating of the valve area prevents the vapour flow from stopping. The computer is programmed so that when the pressure transducer PS1 registers a pressure of about 40 psi (i.e. "heater on" pressure), the heating element H1 is activated and when the pressure is at about 13 psi (i.e. "heater off" pressure), the heater H1 is deactivated. When the cylinder is empty, valves V1 and V2 are closed, pressure transducer PS1 and condenser C1 are deactivated and respective messages are shown indicating that the cylinder 10 is empty, and that valve 11 can be manually closed by the operator and the cylinder 10 disconnected from the flexible end of pipe 14.

Referring now to FIGS. 2, 2*a*, 2*b* and 4, construction and operation of the cylinder-filling apparatus will be described. The cylinder-filling apparatus includes the fluid storage vessel R1, filters F2 and F3, a filling pump P3 and a vacuum pump P2, a flexible pipe $14^2$, valves V4, V5, V6, V7, V8 and V6.1, pressure transducer PS2 and high pressure nitrogen cylinder N2 and a cylinder retainer CR2. The cylinder retainer CR2 includes weighing scales W1 which comprise a load cell 50 and anti-debris members 55. A fire extinguisher cylinder $10^1$ having a valve $11^1$ is also shown. The cylinder $10^1$ rests on weighing scales W1. A polycarbonate safety screen 402 is also included in the cylinder-filling apparatus. Furthermore safety straps which can be attached to hooks (not shown) and are used to secure the cylinder 10, $10^1$ respectively are included in the cylinder emptying and cylinder filling apparatus respectively, as a safety feature.

In order to commence the cylinder filling sequence, the operator presses the button on the computer control panel 401 marked "Fill". A message is subsequently displayed which prompts the operator to connect the cylinder $10^1$ to valve $11^1$ and to then to open valve $11^1$. Under computerized control, valve V4 is then opened and valve V5 is subsequently opened. The vacuum pump P2 which is operating continuously for maximum efficiency of the pump, acts to evacuate air from the cylinder $10^1$.

When the air has been evacuated, V5 is closed and V6 is then opened and liquid halon from the storage vessel R1 is pumped by pump P3 into the cylinder $10^1$ until the weighing scales W1 registers the desired weight on the computer. When the desired weight of liquid halon has been pumped to the cylinder $10^1$, valve V6 is closed and pump P3 is switched off.

There is a short time lag between the moment at which the load cell component of the weighing scales W1 senses the desired weight of halon and the moment at which V6 is fully closed. This time lag leads to some excess liquid halon entering the cylinder $10^1$ resulting in the weight in the cylinder $10^1$ being slightly more than desired. This time lag gives rise to a so-called "in-flight factor". The "in-flight" halon factor is measured and compensated for in the initial requirement parameters programmed into the computer so that the actual desired weight of halon can be achieved accurately.

However, there is also some residual liquid halon (known as "excessive uncertainty halon") in the lines between valve V6 and Valve V4. Since it is undesirable that this amount of halon should be allowed enter the cylinder $10^1$, valve V4 closes, valve V6.1 opens so as to bring pressure generator PG1 into the procedure. In the pressure generator PG1, valves V1, V2 are opened and pump P1 and condenser C1 are switched on. Thus the so-called "excessive uncertainty halon" is evacuated from the lines by pump P1. The amount of liquid halon in the line between valve V4 and valve 11 is measured and can also be compensated for in the initial requirement parameters. When pressure transducer PS1 indicates that the "excessive uncertainty halon" has been evacuated from the line, valves V1, V2 are closed, and pump P1 and condenser C1 are switched off.

Valve V6.1 is then closed, and valves V7 and V4 are opened in that order. With valves V7 and V4 open, nitrogen is delivered to the cylinder $10^1$. The pressure in the line is measured by pressure transducer PS2. When the desired pressure has been achieved, as registered on pressure transducer PS2, an electronic signal is transmitted from pressure transducer PS2 to the computer and V7 is closed consequently.

At this point in the filling process, there is a prompt from the computer for the cylinder $10^1$ to be shaken by the operator so as to achieve homogenous mixing of nitrogen and halon. After the mixing operation, a pressure drop of approximately 50–60 psi is observed. Once this pressure drop has been sensed, valve V7 is opened once more and nitrogen is again delivered to the cylinder $10^1$ until the desired pressure is reached. Valve V7 is then closed and a prompt is given by the computer for valve $11^1$ on the cylinder $10^1$ to be closed. With valve $11^1$ closed, valve V8 is opened so as to allow venting of nitrogen to the atmosphere. When pressure transducer PS2 senses that the pressure has reached a desired value, valve V8 is closed and valve V4 is then closed. A message is displayed on the computer panel indicating that the cylinder filling cycle is complete. The cylinder $10^1$ is then disconnected by the operator from the flexible pipe $14^2$. A silencer (not shown) is included on the outlet from the vent.

Figure 1:
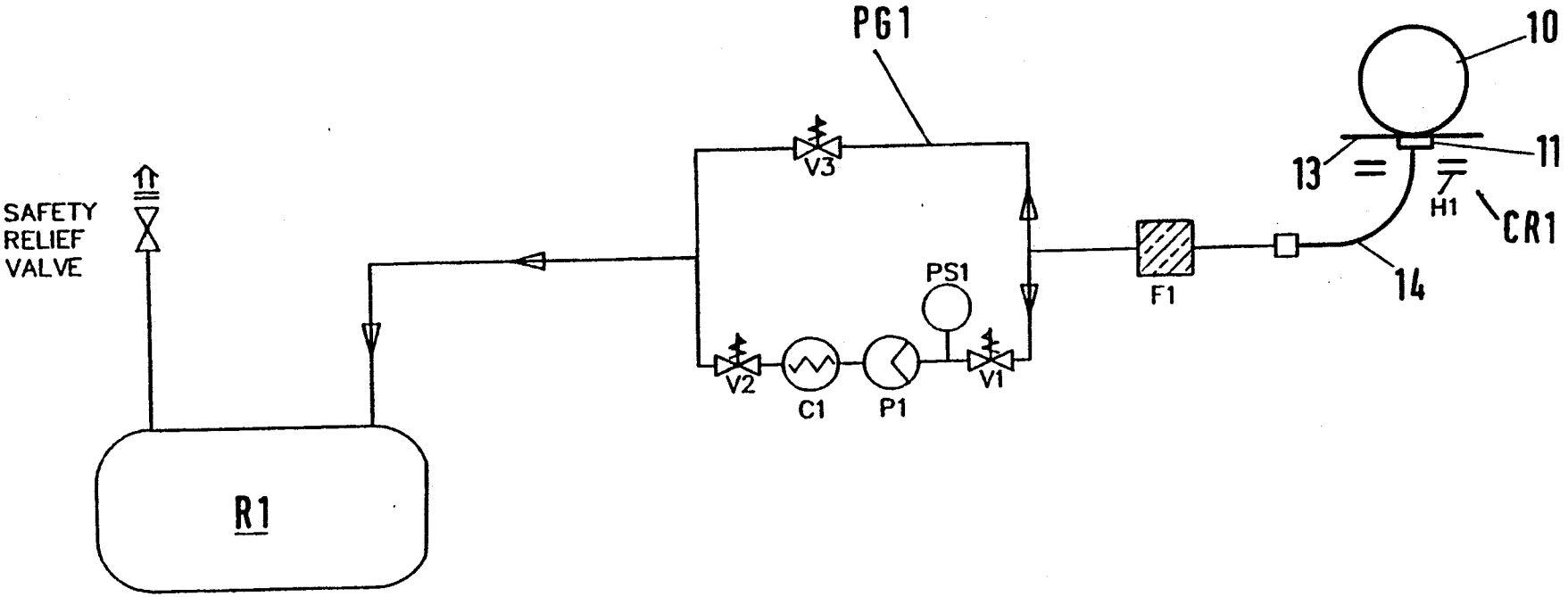
FIG. 1 is a schematic diagram of the cylinder-emptying apparatus.
Figure 1A:
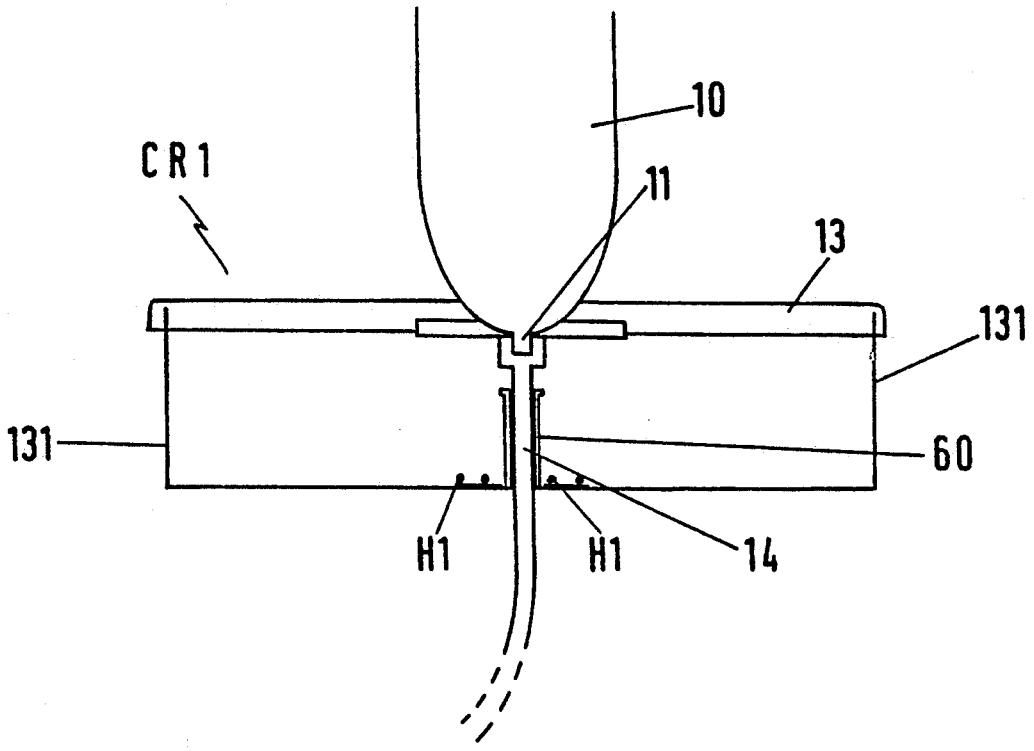
FIG. 1*a* is a sectional side view of a portion of a cylinder positioned for emptying on the cylinder emptying apparatus.
Figure 2A:
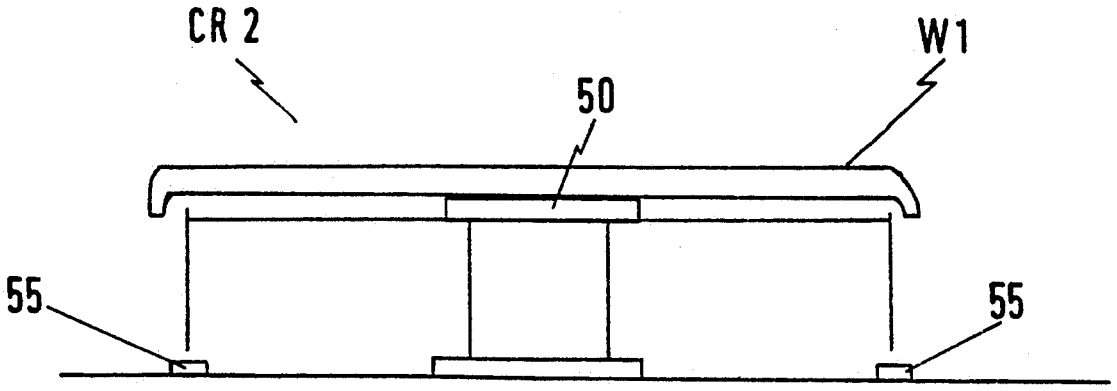
FIG. 2*a* is a sectional view of weighing scales of the apparatus used during filling of a cylinder.
Figure 1B:
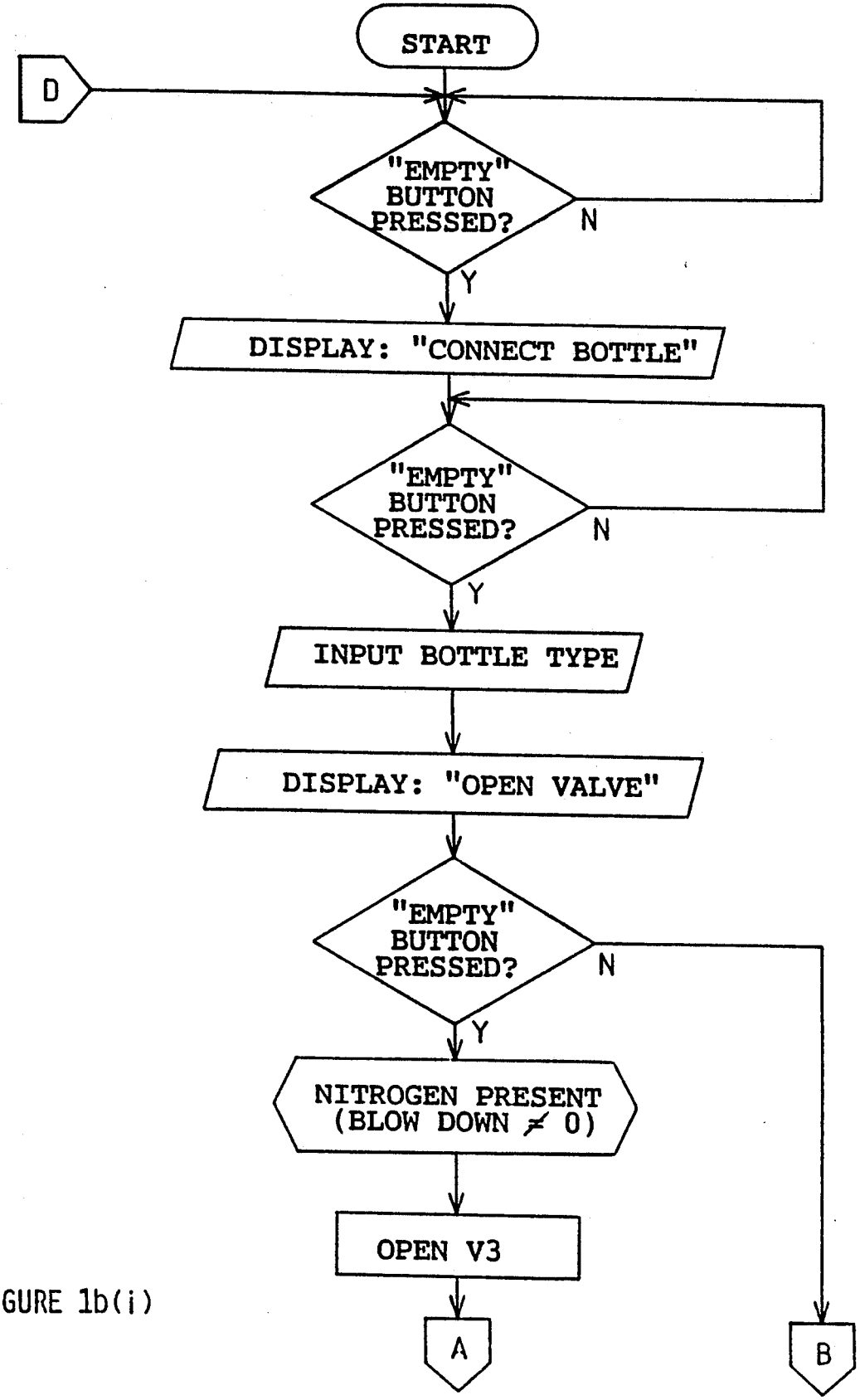
FIG. 1*b* is a flow chart indicating the sequence of steps involved in cylinder-emptying.
Figure 2:
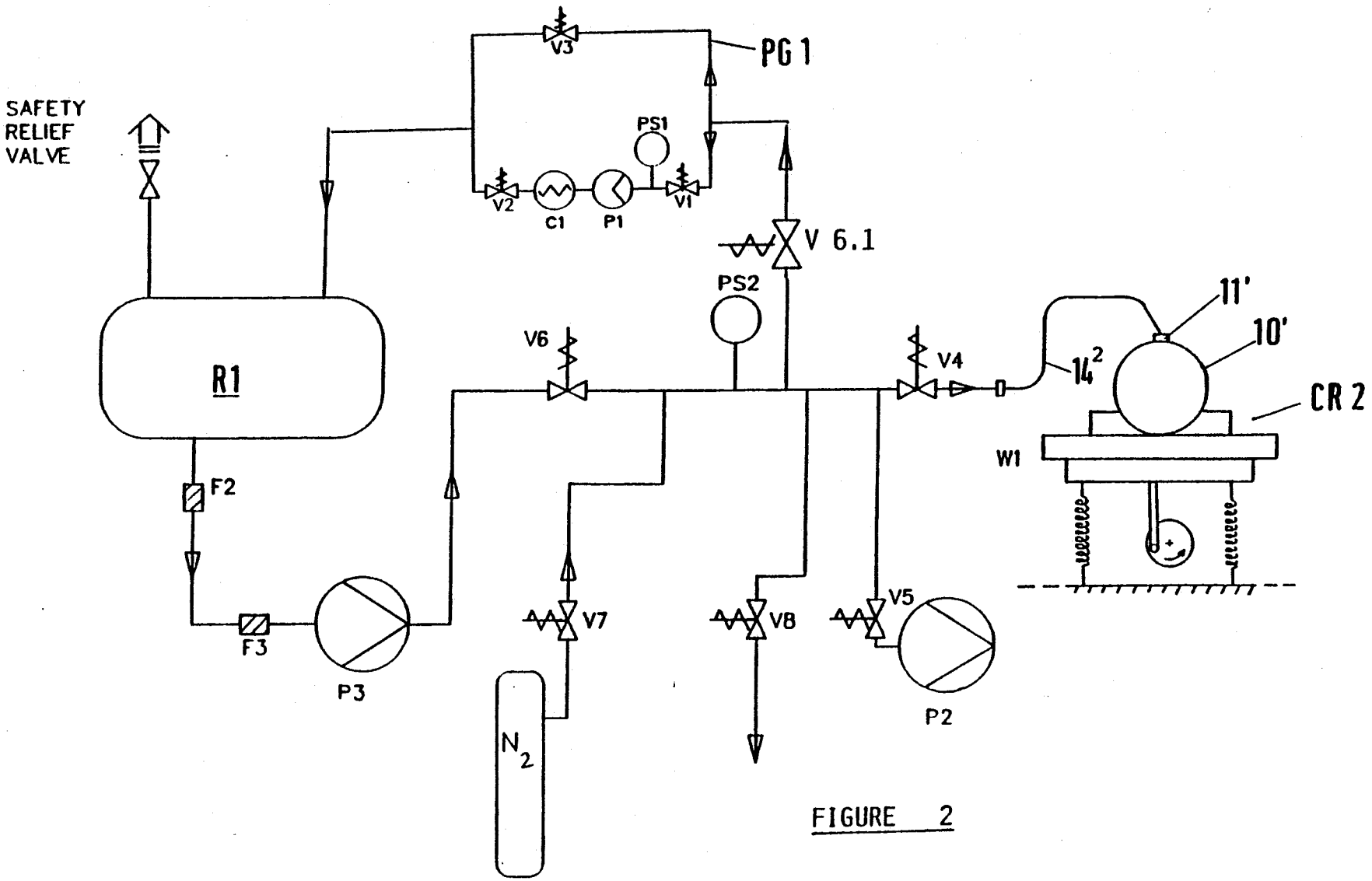
FIG. 2 is a schematic diagram of the cylinder-filling apparatus.
Figure 2B:
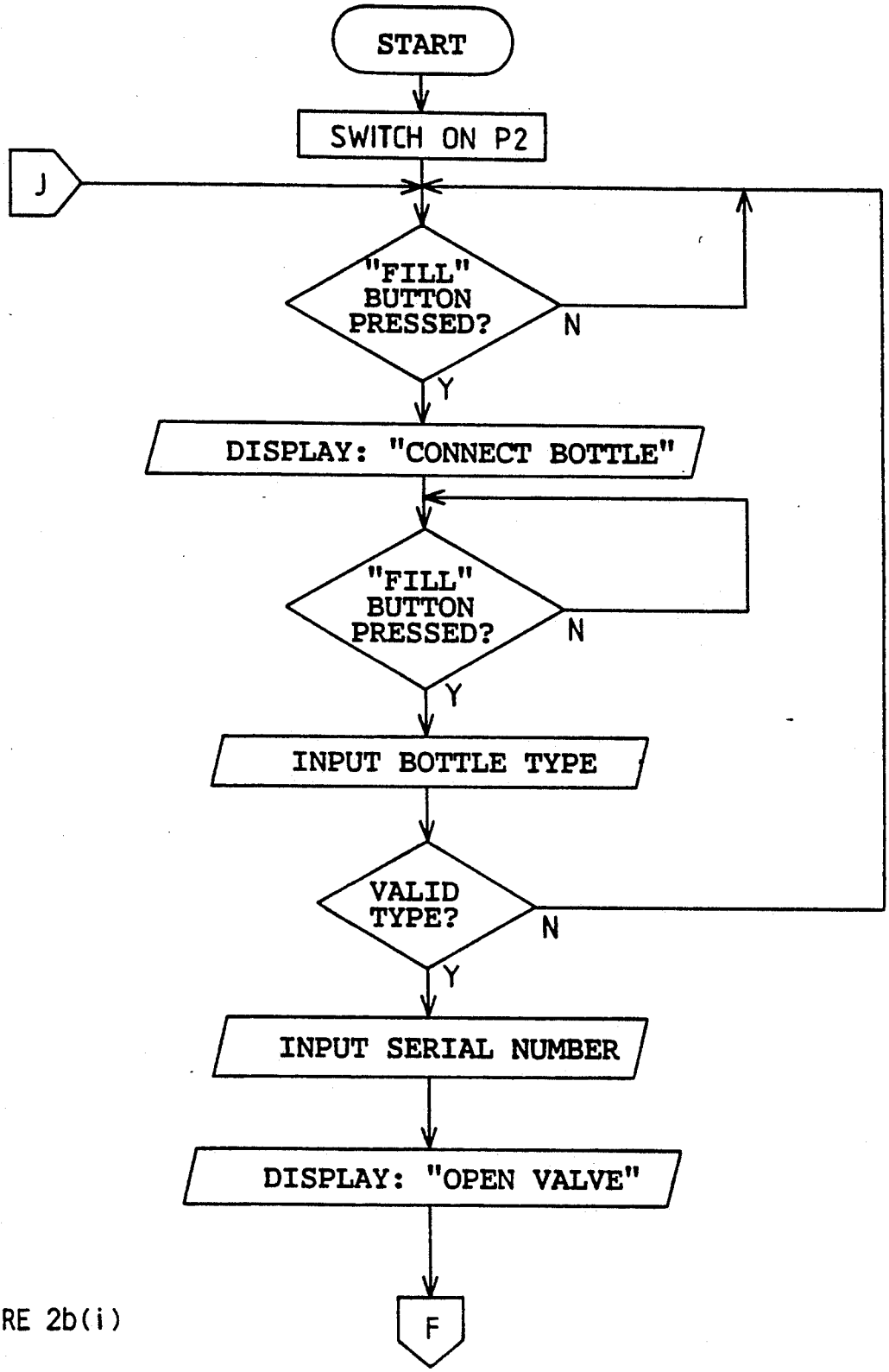
FIG. 2*b* is a flow chart indicating the sequence of steps involved in cylinder-filling.
Figure 2B:
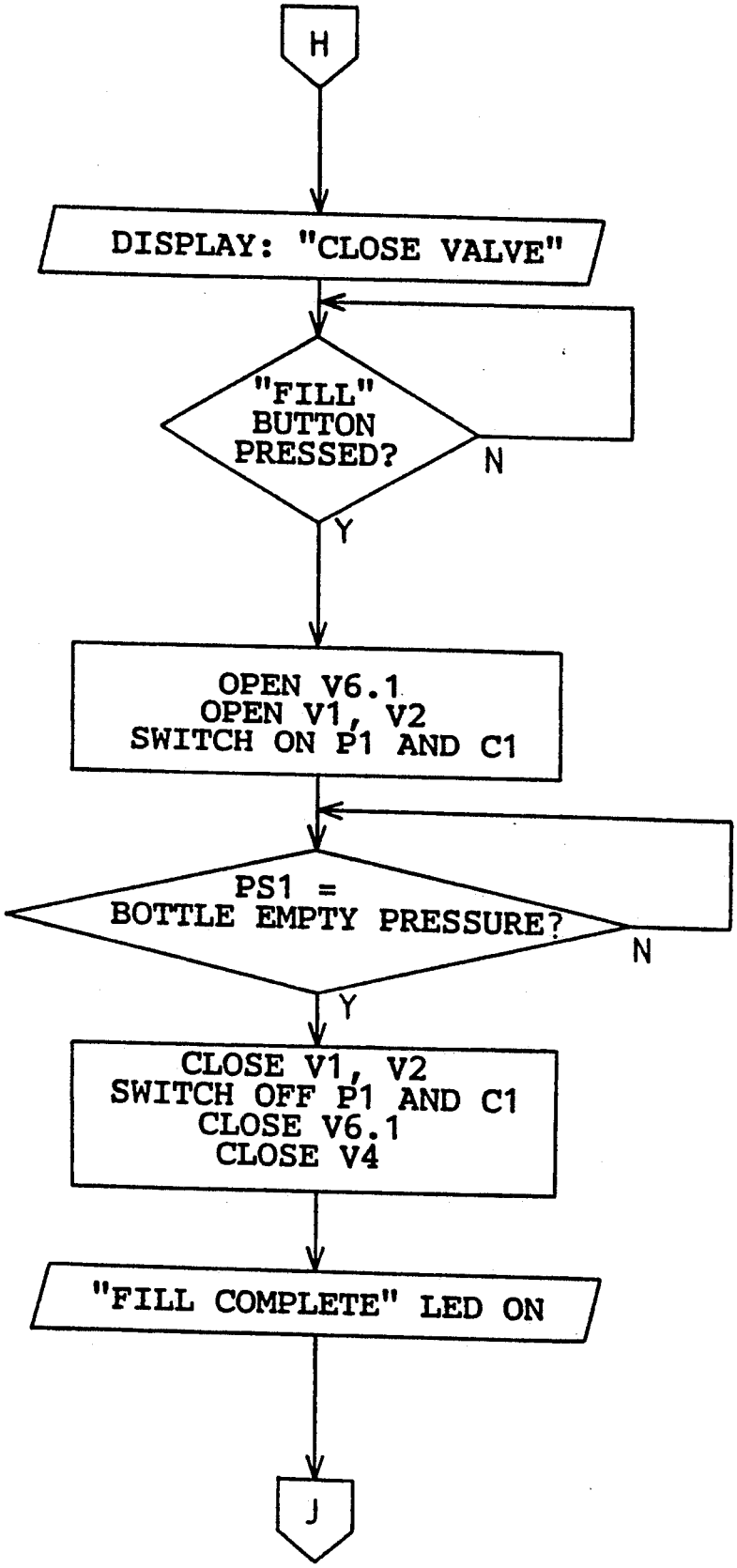
Figure 3:
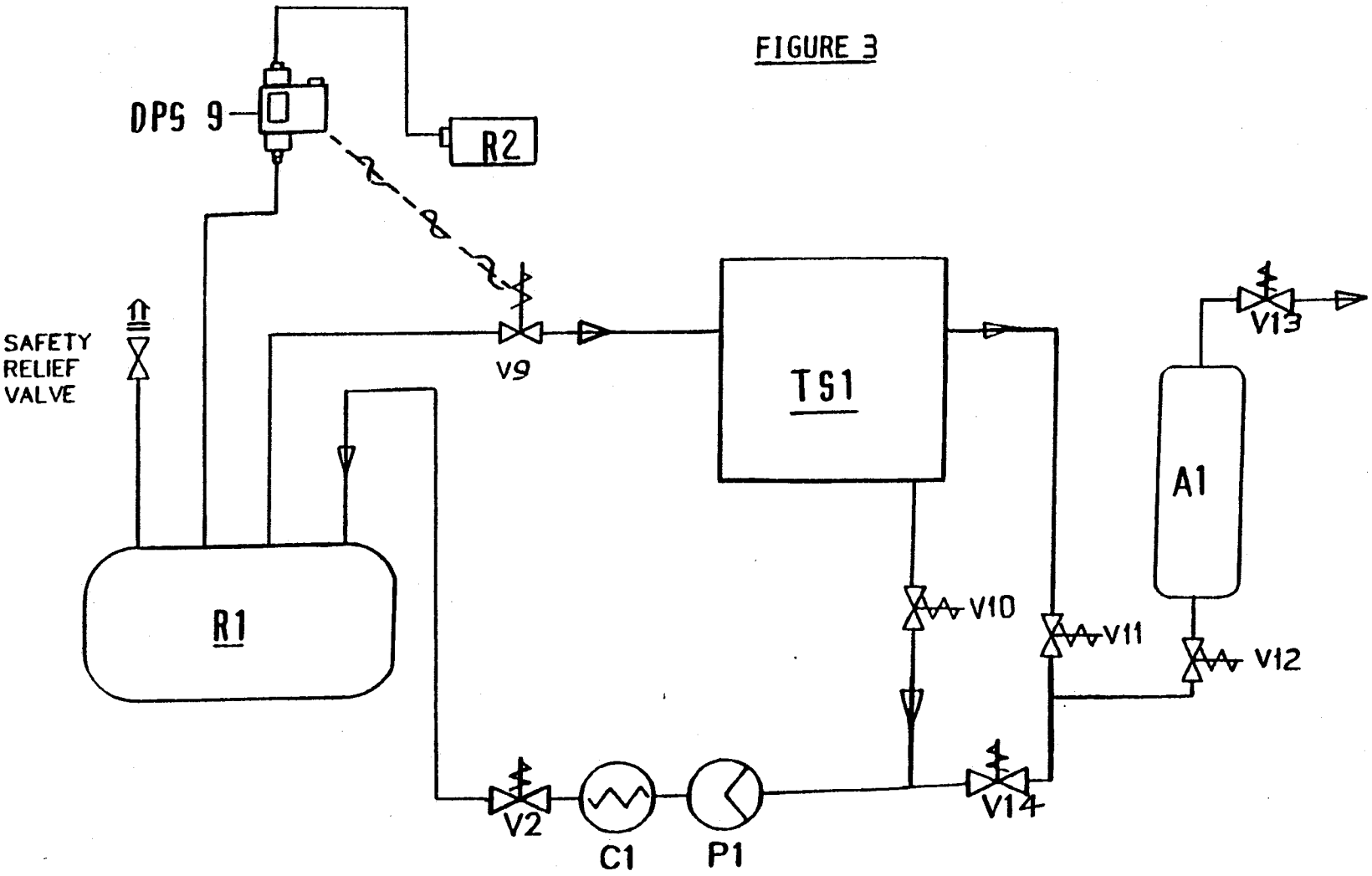
FIG. 3 is a schematic diagram of the fluid-separating apparatus.
Figure 3A:
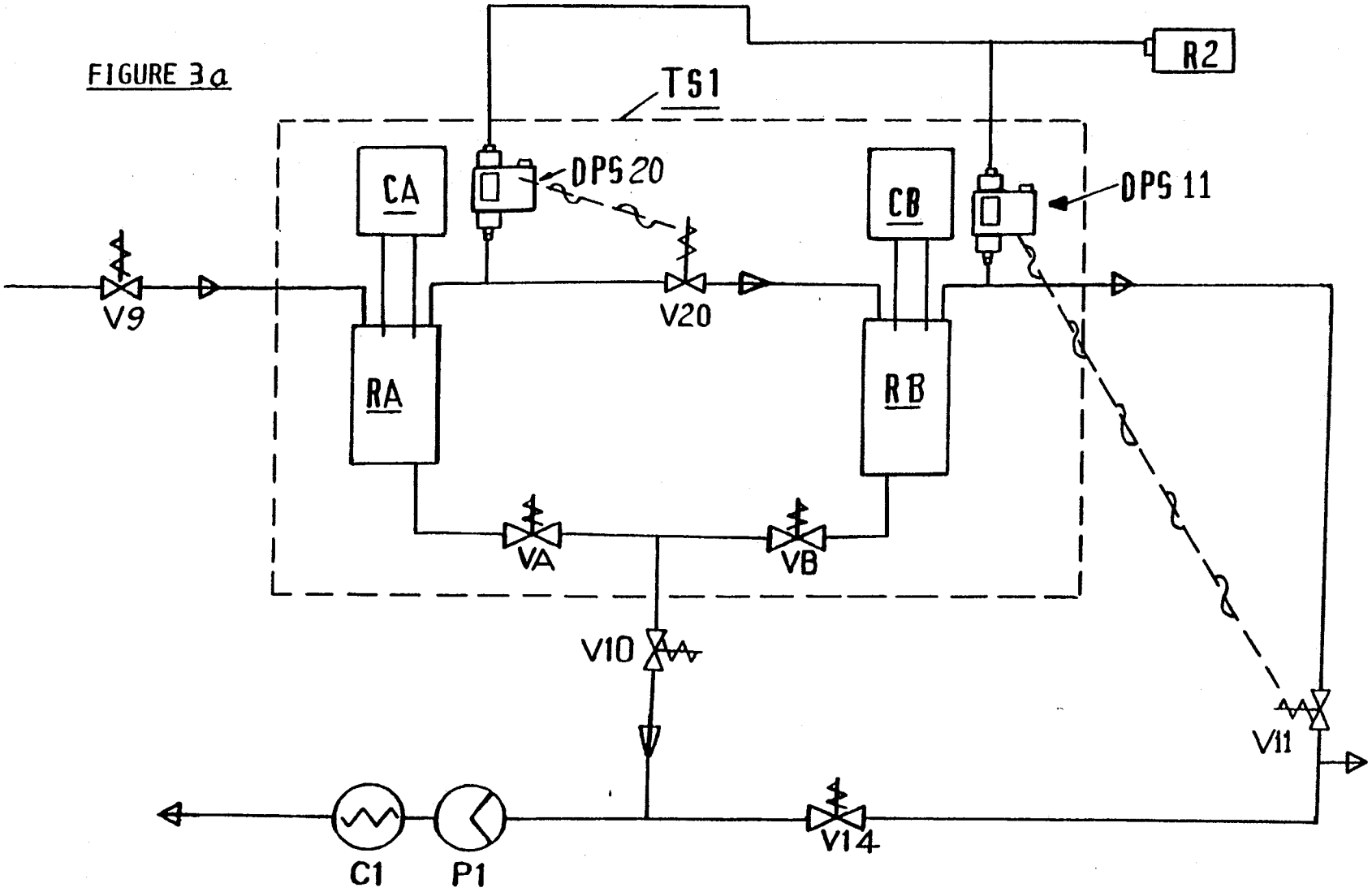
FIG. 3*a* is an enlarged schematic diagram of a thermal separation unit forming part of the fluid separating apparatus.

Referring now to FIGS. 3 and 3*a*, the fluid separating apparatus is shown. The apparatus includes valves V9, V11, and V20, reference cell of pure halon R2, and thermal separation unit TS1. The opening and closing of the valves V9, V11, and V20 is controlled by respective differential pressure switches DPS 9, DPS 11 and DPS 20. Valves V10, V12, V13, V14 are also included in the fluid separating apparatus. The thermal separating unit TS1 (see FIG. 3*a*) comprises receiver RA, condenser CA, valve VA and receiver RB, condenser CB and valve VB. Receiver RA is maintained at a temperature of 0° C. and receiver RB is maintained at −30° C. Receivers RA and RB are surrounded by respective expanded foam insulation jackets (not shown).

The receivers RA and RB contain respective cooling coils (not shown) and respective float switches (not shown). Condenser CA operates intermittently and the actuation thereof is controlled by a thermostat (not shown) on receiver RA. Condenser CB, however is continuously operating. The fluid storage vessel R1 contains liquid halon and a vapour mixture of nitrogen and halon thereabove. Valve V9 opens due to a signal given by the differential pressure switch DPS 9 which measures the pressure in the storage vessel R1 with respect to the reference cell R2. Thus, when the pressure in storage vessel R1 has increased to a pre-determined value measured with respect to reference cell R2, the fluid separation operation commences.

The pressure at any given point in the system is dependent on the vapour pressure of the halogenated hydrocarbon involved and the vapour pressure itself is in turn dependent on the atmospheric temperature. Hence, by measuring the pressure at any given point with reference to the pressure of a cylinder containing only the appropriate halon means that is not necessary at any stage, to measure the absolute pressure. The inclusion of the reference cell in the system achieves the desirable effect that absolute measurement of vapour pressure is not required since it is pressure differences which are being measured at various points in the system.

With valve V9 open, the vapour mixture of halon and nitrogen flows under the force of the pressure differential to receiver RA while liquid halon remains in the storage vessel R1. The halon in the vapour mixture condenses in condenser CA and accordingly the level of liquid halon in receiver RA rises. At a predetermined liquid level, the float switch triggers the opening of valve VA. The activation of the float switch also results in opening of valve V10 and actuation of the pump P1 of pressure generator PG1. Therefore, the liquid halon is pumped from receiver RA to the storage vessel R1 under the action of pump P1, via condenser C1 and via open valve V2. However, receiver RA is not allowed to empty completely since it is desirable that sufficient liquid halon remain in receiver RA so that the cooling coils in the receiver RA are covered by liquid halon. Therefore, when the liquid level in receiver RA has dropped to a certain predetermined level, valve VA closes.

The differential pressure switch DPS 20 measures the pressure in receiver RA with respect to the reference cell R2. Thus, when the vapour pressure differential in receiver RA reaches a pre-determined value with respect to the reference cell, the pressure differential switch DPS 20 triggers the opening of valve V20. Vapour mixture (comprised of nitrogen and a reduced amount of halon) may then flow, under the driving force of a pressure differential, from receiver RA (at 0° C.) to receiver RB (at −30° C.). Since receiver RB is at a lower temperature than receiver RA, further condensation of halon occurs in receiver RB. The halon in the vapour mixture condenses in condenser CB and the level of liquid halon in receiver RB rises accordingly. A float switch in receiver RB triggers the opening of valve VB and valve V10 when a certain liquid level has been reached. The activation of the float switch also results in actuation of the pump P1. Accordingly, the liquid halon is pumped from receiver RB to storage vessel R1 under the action of pump P1. However, as previously explained with reference to receiver RA, receiver RB is not emptied completely so as to maintain a halon liquid level which covers the cooling coils in receiver RB. Therefore, at a predetermined liquid level valve VB closes.

When the vapour pressure differential, measured by differential pressure switch DPS 11, in receiver RB reaches a pre-determined value with respect to the reference cell R2, the pressure differential switch DPS 11 triggers the opening of valve V11 so that the vapour stream containing nitrogen with some halon is discharged to the atmosphere at this point in the separation process.

In an alternative embodiment the vapour mixture is not released to the atmosphere through valve V11 but instead flows to a chemical adsorber A1 via valves V11 and V12. The chemical adsorber A1 contains molecular sieves as the adsorbent medium and also includes a heating coil wrapped about the chemical adsorber A1. Having passed through adsorber A1, the vapour is allowed exit to the atmosphere via valve V13. When the adsorber A1 has been fully charged, valves V11 and V13 are closed by a computer-generated signal. Valves V12 and V14 are opened to connect adsorber A1 to the pump P1. The pump P1 is prompted by the computer to operate by the charged vapour condition in chemical adsorber A1. The halon is pumped back to the storage vessel R1 under the action of pump P1. This regeneration process continues until the pressure in storage vessel R1 is reduced and reaches a pre-determined pressure measured with respect to the reference cell R2 (typically the differential pressure is 4 bar). Valve V9 remains closed until another emptying operation involving flow of halon and nitrogen vapour mixture into storage vessel R1 results in an increase in pressure in storage vessel R1 with respect to reference cylinder R2. When the pressure differential reaches a pre-determined value, the opening of V9 is triggered by differential pressure switch DPS 9 and the fluid separation operation recommences.

Because a limited amount of halon is lost to the atmosphere during the fluid separation operation, it is necessary to periodically replace this halon by topping up the amount of halon in the storage vessel R1 using a cylinder of pure halon.

In a further embodiment, the cylinder-filling system includes a transducer and vibrating means which act to agitate the cylinder contents during pressurizing of said cylinder using inert vapour (nitrogen) when the cylinder is being filled.

The above described cylinder emptying apparatus, cylinder filling apparatus and fluid separating apparatus all combine to provide an integrated recycling machine which mitigates the disadvantages associated with prior art apparatus.

It will of course be understood that the invention is not limited to the specific details described herein, which are given by way of example only, and that various modifications and alterations are possible within the scope of the invention as defined in the appended claims.

We claim:

1. A halogenated hydrocarbon recycling machine comprising a cylinder-emptying apparatus including means for transferring a halogenated hydrocarbon and nitrogen-containing vapour mixture from a cylinder to a reservoir, a cylinder-filling apparatus including means for filling the cylinder from said reservoir and a fluid separating apparatus including means for separating from the vapour mixture of an emptied cylinder, a reusable halogenated hydrocarbon fluid for use by the cylinder filling apparatus.

2. A recycling machine as claimed in claim 1, wherein the fluid separating apparatus comprises a thermal separation unit which includes at least one receiving vessel, at least one condenser and a valve, said condenser being arranged above the receiving vessel so that vapour rising from the receiving vessel is allowed to condense in the condenser and return to the receiving vessel, said valve being located beneath the receiving vessel; said receiving vessel containing a float switch which is operable by the level of liquid in the receiving vessel, to actuate said valve; whereby when the valve is in an open condition, liquid halogenated hydrocarbon may flow from the receiving vessel via said valve to the reservoir.

3. A halogenated hydrocarbon recycling machine comprising a cylinder-emptying apparatus including means for transferring a vapour mixture from a cylinder to a reservoir, a cylinder-filling apparatus including means for filling the cylinder from said reservoir and a fluid separating apparatus including means for separating from the vapour mixture of an emptied cylinder, a reusable halogenated hydrocarbon fluid for use by the cylinder filling apparatus, wherein the fluid separating apparatus comprises a thermal separation unit which includes a plurality of receiving vessels and a plurality of respective condensers, the receiving vessels being arranged in series, each receiving vessel being maintained at a temperature which is lower than that of a receiving vessel occurring earlier in the series, each condenser being arranged above each receiving vessel such that vapour rising from the respective receiving vessel is allowed to condense in the condenser and return to the respective receiving vessel, a plurality of valves, each respective valve being located beneath each receiving vessel, each receiving vessel containing a respective float switch, each of which float switches is operable by the level of liquid in each respective receiving vessel, to actuate said respective valve; whereby when a valve is in an open condition, liquid halogenated hydrocarbon may flow from the respective receiving vessel via said valve to the respective reservoir.

4. A recycling machine as claimed in claim 3 wherein the fluid separating apparatus further comprises a reference cylinder of pure halogenated hydrocarbon having a given vapour pressure, said cylinder being connected via a network of piping to respective differential pressure switches, each differential pressure switch being operable to measure the pressure at given points on said network of piping with respect to said reference cylinder.

5. A recycling machine as claimed in claim 3 wherein the cylinder emptying apparatus further includes a cylinder retaining means including a housing having an aperture adapted to receive a portion of a fire extinguisher cylinder, said cylinder retaining means having a heating element which is located therein, the heating element being positioned within the housing so that when the fire extinguisher is placed in said aperture, an exit valve on said fire extinguisher is located close to the heating element.

6. A recycling machine as claimed in claim 3 wherein the fluid separating apparatus further includes a chemical adsorber having an adsorbent medium comprising molecular sieves.

7. A recycling machine as claimed in claim 1 wherein the cylinder filling apparatus includes cylinder retaining means comprising weighing means.

8. A recycling machine as claimed in claim 7 wherein the weighing means includes a load cell.

9. A recycling machine according to claim 7 in which the cylinder retaining means further comprises anti-debris members.

10. A recycling machine as claimed in claim 1 wherein the cylinder filling apparatus includes vibrating means which act to agitate said fire extinguisher cylinder during pressurizing thereof using inert vapour.

11. A recycling machine as claimed in claim 1, wherein said halogenated hydrocarbon comprises $CF_3BR$.

* * * * *